US009163825B2

(12) United States Patent
Kim

(10) Patent No.: US 9,163,825 B2
(45) Date of Patent: Oct. 20, 2015

(54) LIGHTING DEVICE

(71) Applicant: LG INNOTEK CO., LTD., Seoul (KR)

(72) Inventor: Jae Jin Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 14/584,874

(22) Filed: Dec. 29, 2014

(65) Prior Publication Data

US 2015/0117036 A1 Apr. 30, 2015

Related U.S. Application Data

(63) Continuation of application No. 13/477,882, filed on May 22, 2012, now Pat. No. 8,939,617.

(30) Foreign Application Priority Data

| | | |
|---|---|---|
| May 23, 2011 | (KR) | 10-2011-0048243 |
| Jun. 2, 2011 | (KR) | 10-2011-0053485 |
| Jun. 14, 2011 | (KR) | 10-2011-0057212 |
| Jun. 14, 2011 | (KR) | 10-2011-0057213 |

(51) Int. Cl.

| | |
|---|---|
| ***F21V 29/00*** | (2015.01) |
| ***F21V 29/77*** | (2015.01) |
| ***F21V 29/02*** | (2006.01) |
| ***F21K 99/00*** | (2010.01) |
| ***F21V 29/65*** | (2015.01) |
| ***F21V 29/83*** | (2015.01) |
| *F21Y 105/00* | (2006.01) |
| *F21Y 101/02* | (2006.01) |
| *F21V 29/75* | (2015.01) |
| *F21V 29/76* | (2015.01) |
| *F21V 29/80* | (2015.01) |

(52) U.S. Cl.

CPC ..... *F21V 29/77* (2015.01); *F21K 9/137* (2013.01); *F21V 29/02* (2013.01); *F21V 29/40* (2013.01); *F21V 29/65* (2015.01); *F21V 29/83* (2015.01); *F21V 29/75* (2015.01); *F21V 29/763* (2015.01); *F21V 29/80* (2015.01); *F21Y 2101/02* (2013.01); *F21Y 2105/001* (2013.01)

(58) Field of Classification Search

CPC ..... F21K 9/137; F21V 29/02; F21V 29/40; F21V 29/65; F21V 29/75; F21V 29/77; F21V 29/80; F21V 29/83; F21V 29/763; F21Y 2101/02; F21Y 2105/001

See application file for complete search history.

(56) References Cited

U.S. PATENT DOCUMENTS

| | | | | |
|---|---|---|---|---|
| 7,144,140 | B2 | 12/2006 | Sun et al. | |
| 8,939,617 | B2 * | 1/2015 | Kim | 362/373 |
| 2006/0193139 | A1 | 8/2006 | Sun et al. | |
| 2008/0212333 | A1 | 9/2008 | Chen | |
| 2010/0020537 | A1 | 1/2010 | He et al. | |
| 2010/0246166 | A1 | 9/2010 | Hsu et al. | |

FOREIGN PATENT DOCUMENTS

| | | |
|---|---|---|
| CN | 102042498 A | 5/2011 |

* cited by examiner

*Primary Examiner* — Stephen F Husar

(74) *Attorney, Agent, or Firm* — Birch, Stewart, Kolasch & Birch, LLP

(57) ABSTRACT

A lighting device may be provided that comprises: a light emitting module; a heat sink disposed on the light emitting module; a heat radiating fan disposed on the heat sink; and a housing which receives the light emitting module, the heat sink and the heat radiating fan, and includes an air inlet port and an air outlet port which are separated from each other and formed in a direction in which the lighting emitting module irradiates light, wherein the air inlet port and the air outlet port are disposed on the circumference of the housing, and wherein the air inlet port and the air outlet port are alternately disposed.

20 Claims, 12 Drawing Sheets

(A)

(B)

LIGHTING DEVICE

This application is a Continuation application of U.S. application Ser. No. 13/477,882 filed May 22, 2012, now U.S. Pat. No. 8,939,671, which claims priority from Korean Application No. 10-2011-0048243 filed May 23, 2011, No. 10-2011-0053485 filed Jun. 2, 2011, No. 10-2011-0057212 filed Jun. 14, 2011, and No. 10-2011-0057213 filed Jun. 14, 2011, the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting device using the LED.

However, much heat is generated when the LED is lighted. Further, when the heat is not readily radiated, the life span of the LED becomes shorter, illuminance is degraded and quality characteristic is remarkably deteriorated. Therefore, advantages of the LED light device can be obtained under the condition that the heat of the LED is easily radiated.

SUMMARY

One embodiment is a lighting device. The lighting device includes: A lighting device may be provided that comprises: a light emitting module; a heat sink disposed on the light emitting module; a heat radiating fan disposed on the heat sink; and a housing which receives the light emitting module, the heat sink and the heat radiating fan, and includes an air inlet port and an air outlet port which are separated from each other and formed in a direction in which the lighting emitting module irradiates light, wherein the air inlet port and the air outlet port are disposed on the circumference of the housing, and wherein the air inlet port and the air outlet port are alternately disposed.

Another embodiment is a lighting device. The lighting device includes: a light emitting module; a heat sink disposed on the light emitting module; a heat radiating fan disposed on the heat sink; and a housing which receives the light emitting module, the heat sink and the heat radiating fan, and includes an air inlet port and an air outlet port which are separated from each other and formed in a direction in which the lighting emitting module irradiates light, wherein the air inlet port is disposed closer to the center of the housing than the air outlet port.

Further another embodiment is a lighting device. The lighting device includes: a light emitting module; a heat sink disposed on the light emitting module; a heat radiating fan disposed on the heat sink; and a housing which receives the light emitting module, the heat sink and the heat radiating fan, and includes an air inlet port and an air outlet port, wherein the heat sink comprises a base plate and a plurality of heat radiating fins extended from the base plate, wherein the heat radiating fan injects an air provided from the air inlet port into the heat sink, and wherein the heat radiating fins guide the air to the outlet port of the housing.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
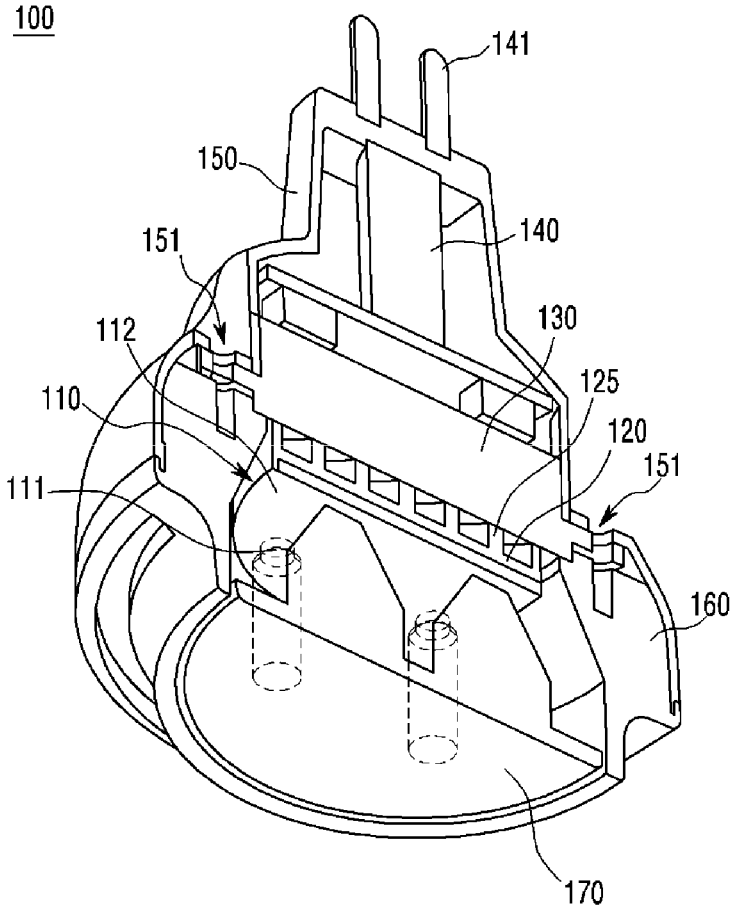
FIG. 1 is a sectional perspective view of a lighting device according to an embodiment of the present invention.

FIG. 1 is a sectional perspective view of a lighting device according to an embodiment of the present invention.

A lighting device 100 according to an embodiment of the present invention may include a light emitting module 110, a heat sink 120 which is coupled to the light emitting module 110 and includes a heat radiating fin, a heat radiating fan 130 disposed on the heat sink 120, an upper case 150 covering the heat radiating fan 130, a driving unit 140 which is electrically connected to an LED mounting substrate 112 and the heat radiating fan 130 disposed within the upper case 150, and supplies electric power, and a lower case 160 coupled to the upper case 150 and fixes the light emitting module 110.

Each component will be described in detail as follows.

<Light Emitting Module>

The light emitting module 110 may include at least one LED 111 and the LED mounting substrate 112 on which the LEDs 111 are disposed.

A plurality of the LEDs 111 may be disposed on the LED mounting substrate 112. The number and arrangement of the LEDs 11 to be disposed can be freely adjusted depending on a required illuminance. The light emitting module 110 may be formed in the form of a plurality of the collected LEDs 111 such that it can be easily handled and advantageously produced.

The LED mounting substrate 112 may be formed by printing a circuit pattern in an insulator. For example, the LED mounting substrate 112 may include not only a printed circuit board (PCB), a metal core PCB, a flexible PCB and a ceramic PCB, but also a chips on board (COB) allowing an unpackaged LED chip to be directly bonded thereon. The LED mounting substrate 112 may be formed of a material which efficiently reflects light. The surface of the LED mounting substrate 112 may have a color capable of efficiently reflecting light, for example, white, silver and the like.

The LED 111 disposed on the LED mounting substrate 112 may be at least one of a red LED, green LED, blue LED or white LED, each of which emits red, green, blue or white light respectively. There is no limit to the kind and the number of the LEDs 111.

<Heat Sink>

The heat sink 120 is disposed on the light emitting module 110 and is able to receive and radiate heat generated from the light emitting module 110.

The surface of the heat sink 120 may have a plurality of heat radiating fins 125. A plurality of the heat radiating fins 125 may be radially disposed along the surface of the heat sink 120. A plurality of the heat radiating fins 125 increases the surface area of the heat sink 120, thereby improving the heat radiation efficiency of the heat sink 120.

The heat sink 120 allows air injected from the heat radiating fan 130 into the heat sink 120 to pass the surface of the heat sink 120 and to be emitted through an air outlet port of the lower case 160. The heat sink 120 may include the heat radiating fins 125 which are arranged in a certain direction. For example, the heat radiating fins 125 of the heat sink 120 may be arranged both perpendicular to a direction of the air injected from the heat radiating fan 130 and toward the air outlet port of the lower case 160.

The arrangement direction and disposition of the heat radiating fins 125 will be described in more detail in FIGS. 3 and 4.

The heat sink 120 is separated from an air inlet port and disposed to be exposed by the air outlet port. As a result, air coming into the lighting device 100 according to the embodiment is maintained to have a normal temperature, and air which is emitted comes in contact with the heat sink 120 as much as possible. Therefore, the lighting device 100 according to the embodiment radiates the heat of the heat sink 120 to the outside by using the air which is emitted through the air outlet port. Here, the heat sink 120 may be separated from the air inlet port by a partition within the lower case 160.

The heat sink 120 may be formed of a metallic material or a resin material which has high heat radiation efficiency. The material of the heat sink 120 is not limited. For example, the material of the heat sink 120 may include at least one of Al, Ni, Cu, Ag and Sn.

Though not shown in the drawing, a heat radiating plate (not shown) may be disposed between the light emitting module 110 and the heat sink 120. The heat radiating plate (not shown) may be formed of a thermal conduction silicon pad or a thermal conductive tape which has a high thermal conductivity. The heat radiating plate is able to effectively transfer the heat generated from the light emitting module 110 to the heat sink 120.

<Heat Radiating Fan>

Figure 2:
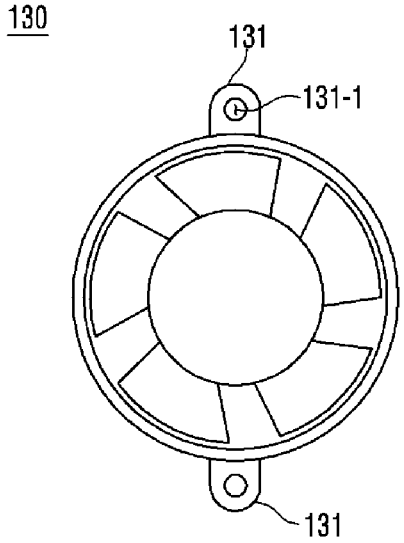
FIG. 2 is a plan view of a heat radiating fan shown in FIG. 1.

FIG. 2 is a plan view of a heat radiating fan 130 shown in FIG. 1.

Referring to FIGS. 1 and 2, the heat radiating fan 130 is disposed on the heat sink 120. The heat radiating fan 130 is able to perform a function of reducing the heat within the lighting device 100 by forcedly generating convection of the air within the lighting device 100.

When electric power is applied to the lighting device 100, light is emitted and much heat is generated from the light emitting module 110. The heat radiating fan 130 functions to reduce the much heat generated from the light emitting module 110.

The heat radiating fan 130 may be driven simultaneously with the driving of the light emitting module 110, or may be driven only when a temperature within the lighting device 100 is equal to or higher than a predetermined temperature. Here, the temperature within the lighting device 100 may be detected by using a thermal sensor.

When the heat radiating fan 130 is operated, external air is inhaled through the air inlet port of the lower case 160. The inhaled air passes through the heat radiating fan 130. The air which has passed through the heat radiating fan 130 exchanges the heat with the heat sink 120 while passing through the heat sink 120. Then, the air heated through the heat exchange may be emitted through the air outlet port of the lower case 160.

Also, since the heat radiating fan 130 is disposed separately from the heat sink 120, it is possible to obtain a space allowing the air emitted from the heat radiating fan 130 to sufficiently flow.

In a detailed embodiment, the lighting device 100 may be "MR16". When the lighting device 100 is MR16, the external diameter of MR16 may be 50 mm and the diameter of the heat radiating fan 130 may be 30 mm. According to the shape of MR16 formed in the form of a hemisphere, since the width of the lighting device 100 increases with the approach to the lower portion thereof, the heat sink 120 may be formed to have its maximum size for the heat radiation and may have a diameter larger than that of the heat radiating fan 130.

The air may be directly injected from the heat radiating fan 130 to only some surfaces of the heat sink 120. Also, as mentioned in the description of the heat sink 120, the arrangement of the heat radiating fins 125 may be specified in such a manner that the injected air passes all of the surfaces of the heat sink 120.

A coupler 131 may be disposed on the outside of the heat radiating fan 130 such that the heat radiating fan 130 is coupled to the upper case 150. The coupler 131 may be extended outwardly from one side or both sides of the heat radiating fan 130. The coupler 131 may have a hole 131-1 into which a screw is inserted.

<Upper Case and Lower Case>

The upper case 150 covers the outside of the heat radiating fan 130 and is coupled to the lower case 160, so that the upper case 150 may include an air path allowing the air introduced into the lighting device 100 to be emitted along a certain path.

A terminal 141 for supplying electric power may be disposed on the outside of the upper case 150.

The driving unit 140 may be disposed within the upper case 150. The driving unit 140 is electrically connected to the heat radiating fan 130 and the light emitting module 110, and supplies electric power supplied from the terminal 141 to the heat radiating fan 130 and the light emitting module 110.

The driving unit 140 may be formed by mounting various electronic components for driving the LED 111 on the PCB. Here, the terminal 141 is mounted on the top surface of the PCB. The terminal 141 penetrates the upper case 150, so that the terminal 141 is partially exposed upward. The terminal 141 can be electrically connected to an external electrical outlet by using the exposed part of the terminal 141.

The terminal 141 may be formed in the form of a pin inserted close to the rear end of the upper case 150 (shown with two terminals in the drawing). However, the shape of the terminal 141 is not limited to this. The terminal 141 functions as an entrance for receiving an electric power from an external power supply (a DC power supply is assumed, however, the terminal 141 may accept an AC power supply and include either a rectifier or a condenser disposed therein) to the lighting device of the present invention.

The upper case 150, the heat radiating fan 130 and the lower case 160 may respectively have a common hole 151. Two holes 151 may be provided. The upper case 150, the heat radiating fan 130 and the lower case 160 may be coupled to each other by fastening a screw into the two holes 151.

When the screw is fastened into the two holes 151, the lower case 160 is able to hold and fix the outer portion of the light emitting module 110. Also, a space for receiving the light emitting module 110 is formed in the lower case 160, so that the light emitting module 110 may be disposed in the receiving space of the lower case 160.

The lower case 160 may include the air inlet port and the air outlet port which are formed in a direction in which the lighting device 100 irradiates light. The air inlet port and the air outlet port are configured and disposed independently of each other. The air inlet port may be used to allow external air to be introduced into the lighting device 100. The air outlet port may be used to allow the air processed by the heat exchange within the lighting device 100 to be emitted therethrough.

Regarding the air path of the lighting device 100 according to the embodiment, the air outside the lighting device 100 is introduced into a space between the upper case 150 and the heat radiating fan 130 through the air inlet port of the lower case 160, and then is inhaled into the heat radiating fan 130 by the operation of the heat radiating fan 130 and is injected into the space between the heat radiating fan 130 and the heat sink 120. The injected air cools the heat sink 120 through the heat exchange with the heat sink 120, and then is emitted through the air outlet port of the lower case 160.

The upper case 150 or the lower case 160 may include a partition in order to distinguish between the air introduction path through the air inlet port and the air emission path through the air outlet port.

When the lighting device 100 according to the embodiment is used buried in a wall or a ceiling, since the air inlet port and the air outlet port are not placed in a buried portion of the lighting device 100 but placed in externally exposed portion of the lighting device 100, the external air can be effectively introduced and emitted.

A lens 170 may be disposed in the lower case 160. The lens 170 is formed over the LEDs 111 and may collect light emitted from the LEDs 111 or distribute at a predetermined angle. The lens 170 may protect the LEDs 111 from external impact.

Figure 3:
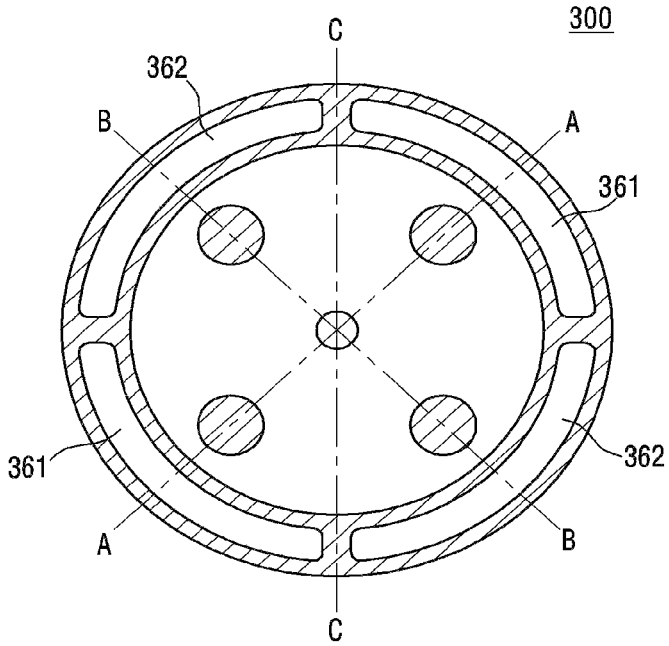
FIG. 3 is a bottom plan view of a lighting device according to another embodiment of the present invention.
Figure 5:
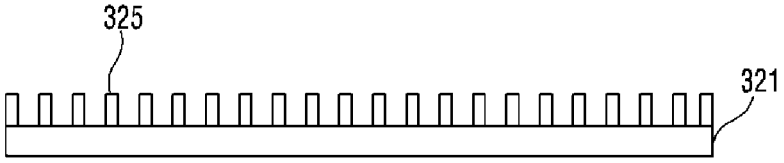
FIG. 5 is a cross sectional view of the heat sink shown in FIG. 4.
Figure 5:
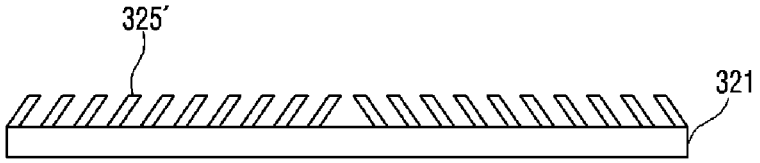
Figure 6:
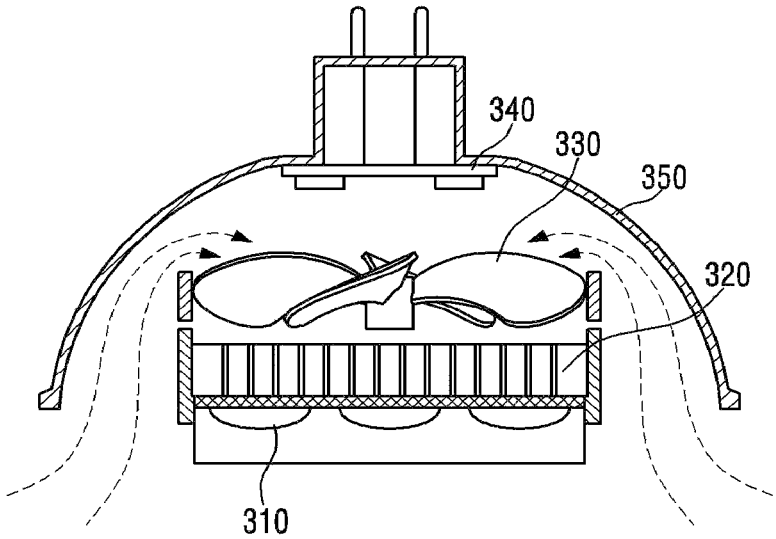
FIG. 6 is a cross sectional view of FIG. 3 taken along line A-A.
Figure 7:
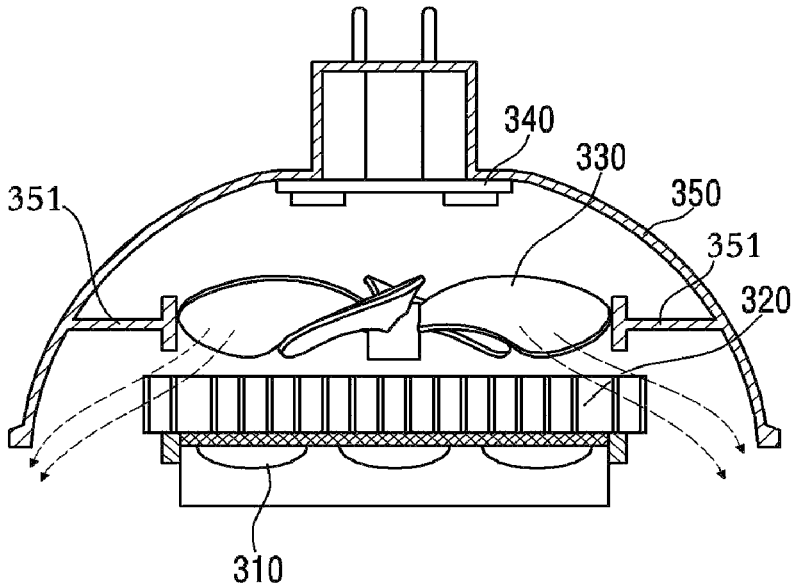
FIG. 7 is a cross sectional view of FIG. 3 taken along line B-B.
Figure 8:
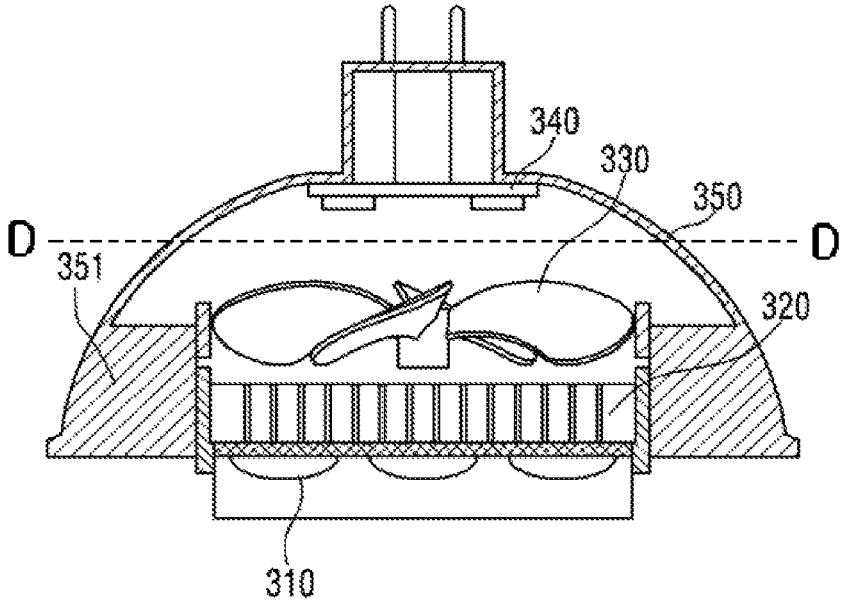
FIG. 8 is a cross sectional view of FIG. 3 taken along line C-C.
Figure 9:
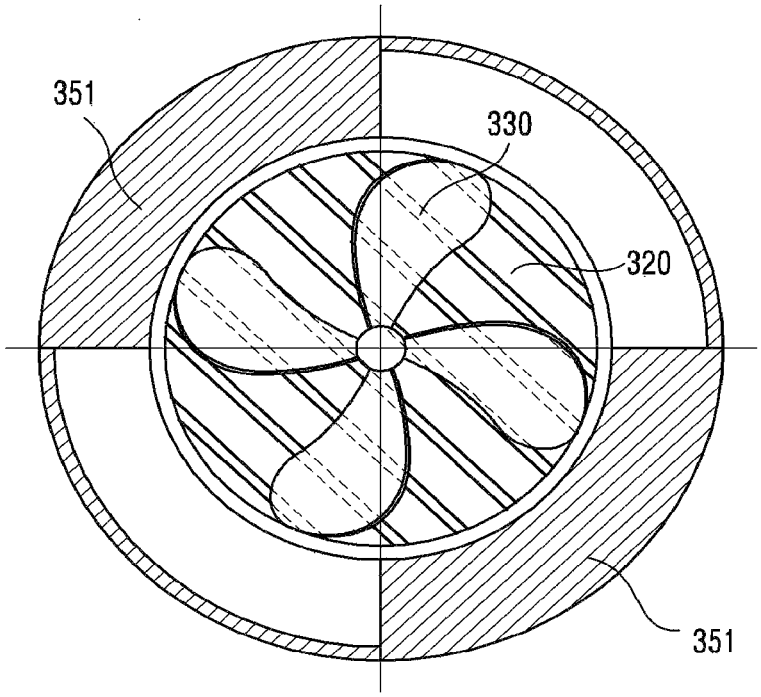
FIG. 9 is a cross sectional view of FIG. 8 taken along line D-D.

FIG. 3 is a bottom plan view of a lighting device 300 according to another embodiment of the present invention. FIG. 4 is a plan view of a heat sink of the lighting device 300 according to the another embodiment of the present invention. FIG. 5 is a cross sectional view of the heat sink shown in FIG. 4. FIG. 6 is a cross sectional view of FIG. 3 taken along line A-A. FIG. 7 is a cross sectional view of FIG. 3 taken along line B-B. FIG. 8 is a cross sectional view of FIG. 3 taken along line C-C. FIG. 9 is a cross sectional view of FIG. 8 taken along line D-D.

Referring to FIGS. 3 to 9, the lighting device 300 according to the another embodiment of the present invention may include a light emitting module 310, a heat sink 320 disposed on the light emitting module 310, a heat radiating fan 330 disposed on the heat sink 320, and a housing 350 receiving the light emitting module 310, the heat sink 320 and the heat radiating fan 330.

The light emitting module 310, the heat sink 320 and the heat radiating fan 330 may be the same as the light emitting module 110, the heat sink 120 and the heat radiating fan 130 of the lighting device 100 according to the embodiment shown in FIGS. 1 and 2.

Unlike the lighting device 100 according to the embodiment shown in FIG. 1, the lighting device 300 according to the another embodiment includes the housing 350 receiving the light emitting module 310, the heat sink 320 and the heat radiating fan 330. Here, the housing 350 may be divided into the upper case 150 and the lower case 160 of the lighting device 100 according to the embodiment shown in FIG. 1, or may be integrally formed.

A driving unit 340 is disposed within the housing 350 and supplies external electric power to the heat radiating fan 330 and the light emitting module 310.

An air inlet port 361 and an air outlet port 362 may be formed in the lower portion of the housing 350, that is to say, a portion of the housing 350, through which light is emitted from the light emitting module 310. An air path may be formed in the housing 350 in such a manner that the air introduced from the air inlet port 361 passes through the heat radiating fan 330, and then the air which has passed through the heat radiating fan 330 passes by the heat sink 320 and is emitted through the air outlet port 362. The air path connected to the air inlet port 361 and the air outlet port 362 may be separated from each other by the heat radiating fan 330 and a partition 351 within the housing 350.

Figure 4:
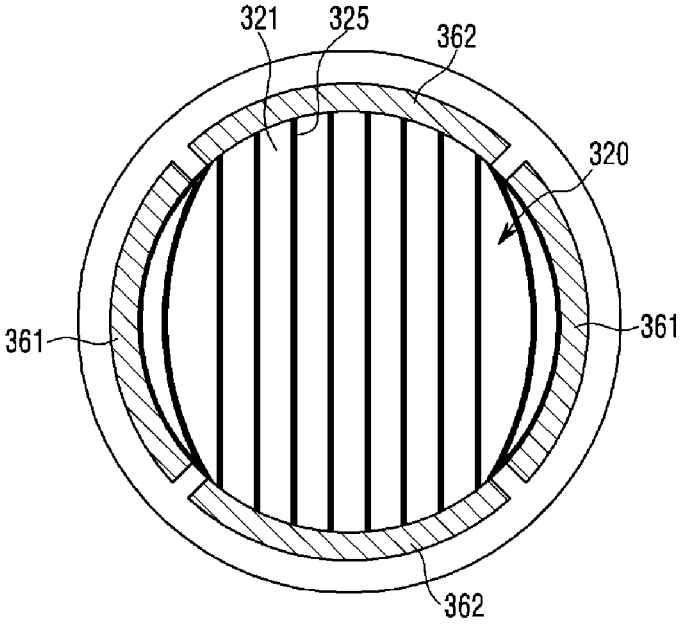
FIG. 4 is a plan view of a heat sink of the lighting device according to the another embodiment of the present invention.

Referring to FIG. 4, the heat sink 320 may include a base plate 321 and heat radiating fins 325 disposed on the base plate. The heat radiating fins 325 may be arranged toward the air outlet port 362 and may be disposed to blocks the air inlet port 361 lest the air introduced into the heat sink 320 by the heat radiating fan 330 should be emitted through the air inlet port 361. As a result of this, the air emitted from the heat radiating fan 330 is emitted through the air outlet port 362 without moving toward the air inlet port 361.

As described above, the air introduced from the heat radiating fan 330 by the arrangement of the heat radiating fins 325 passes the entire surface of the heat sink 325 and is emitted only through the air outlet port 362. As a result, heat dissipation efficiency of the entire heat sink 320 is improved and the air flow can be appropriately controlled.

The partition 351 within the lighting device may prevent the air emitted from the heat radiating fan 330 from flowing toward the air inlet port 361.

As shown in (A) of FIG. 5, the heat radiating fins 325 may be disposed perpendicular to the base plate 321. Here, when the heat radiating fins 325 are perpendicular to the base plate 321, the air emitted from the heat radiating fan 330 collides with and reflects from the heat sink 320, and moves toward the heat radiating fan 330, and then may function as a force causing the heat radiating fan 330 to be operated in a reverse direction. To overcome this problem, as shown in (B) of FIG. 5, heat radiating fins 325' may not be disposed perpendicular to the base plate 321 but be obliquely disposed toward the center of the base plate 321. When the heat radiating fins 325' are obliquely disposed toward the center of the base plate 321, the air emitted from the heat radiating fan 330 is introduced between the heat radiating fins 325' and is reflected to the heat radiating fan 330. Here, the amount of the reflected air may be notably reduced. Accordingly, the force opposing the driving force of the heat radiating fan 330 is reduced and the heat radiating fan 330 can be more efficiently driven.

Referring to FIG. 6, shown is an air introduction path of the lighting device 300 according to the another embodiment. Due to the operation of the heat radiating fan 330, the air outside the lighting device 300 passes through the air inlet port 361 and moves to a space between the housing 350 and the upper portion of the heat radiating fan 330. According to the embodiment shown in FIG. 1, when the heat radiating fan 130 is operated, the outside air would move to a space between the upper case 150 and the upper portion of the heat radiating fan 130.

The heat sink 320 may be separated from the air introduction path. As a result, the air introduced from the air inlet port 361 maintains its temperature to be a normal temperature without contact with the heat sink 320 and is introduced into the lighting device 300. If the introduced air first contacts with the heat sink 320, heated air is introduced into the space between the housing 350 and the upper portion of the heat radiating fan 330, so that the driving unit 340 may not be effectively cooled.

The introduced air is maintained to have a normal temperature and is moved to the space between the housing 350 and the upper portion of the heat radiating fan 330. Then, the driving unit 340 can be cooled through the heat exchange between the air and the driving unit 340 of the lighting device 300.

Referring to FIG. 7, shown is an air emission path of the lighting device 300 according to the another embodiment. As shown in FIG. 7, the air introduced into the upper portion of the heat radiating fan 330 is injected into a space between the lower portion of the heat radiating fan 330 and the heat sink 320 by the operation of the heat radiating fan 330. The injected air passes the surface of the heat sink 320 and exchanges heat with the heat sink 320, thereby cooling the heat sink 320 which has received the heat from the light emitting module 310.

Referring to FIGS. 8 and 9, the inside of the housing 350, which corresponds to the air outlet port 362, is blocked with the partition 351. Therefore, the air heated by the heat sink 320 does not come into the lighting device 300 but is emitted to the outside of the lighting device 300 by the operation of the heat radiating fan 330.

Figure 10:
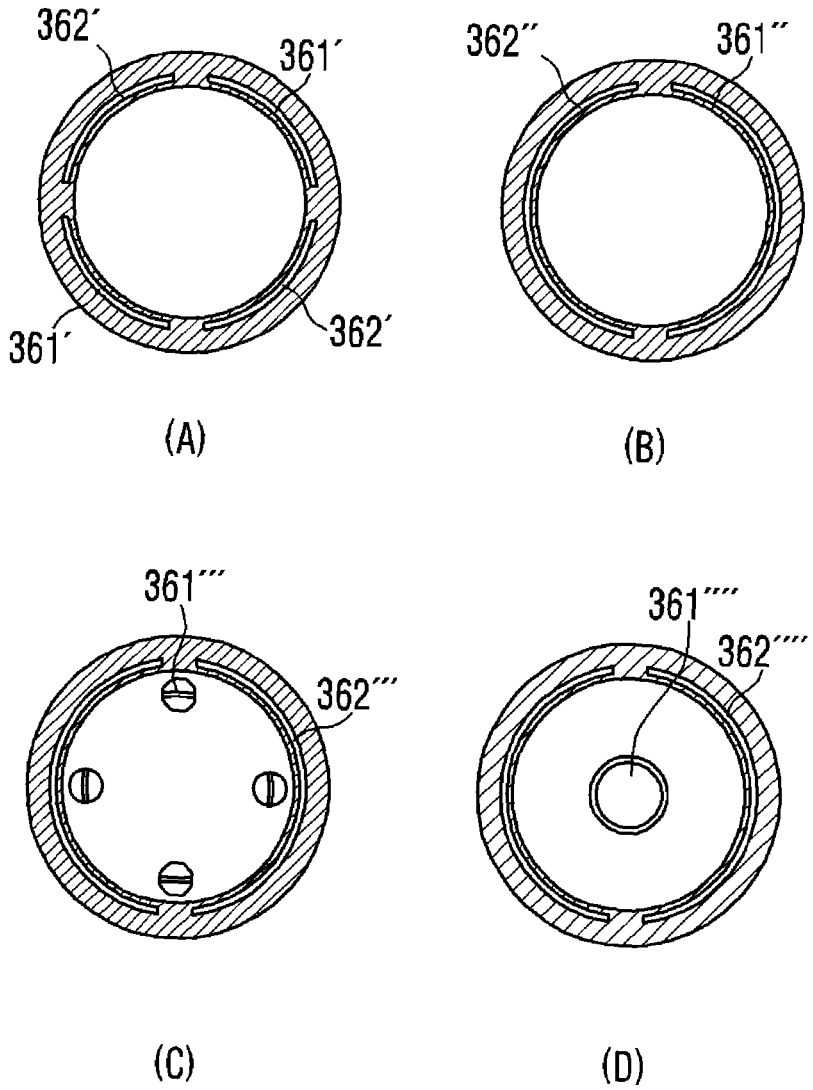
FIG. 10 is a view showing modified examples of an air inlet port and an air outlet port which are shown in FIG. 3.

FIG. 10 is a view showing modified examples of an air inlet port and an air outlet port which are shown in FIG. 3.

As shown in (A) and (B) of FIG. 10, air inlet ports 361' and 361" and air outlet ports 362' and 362" may be formed on the circumference of the housing (or the lower case) in the form of a circular are.

In (A) of FIG. 10, shown is a case where the air inlet port 361' and the air outlet port 362' are alternately formed on the circumference of the housing. Here, "the circumference of the housing" means the edge of the housing. How far the air inlet port 361' and the air outlet port 362' are formed from the center of the housing may be freely determined depending on the type of the embodiment of the present invention. As shown in (A) and (B) of FIG. 10, the air inlet port 361 and the air outlet port 362 may be formed in the form of a circular arc forming a concentric circle with the circular housing.

As shown in (C) of FIG. 10, an air inlet port 361''' may be disposed more inside than an air outlet port 362'''. As shown in (D) of FIG. 10, an air inlet port 361'''' may be disposed at the center of the housing and an air outlet port 362'''' may be disposed on the circumference of the housing. The air inlet port 361'''' and the air outlet port 362'''' may have various shapes such as a circle, a polygon and the like as well as the circular arc. As shown in (C) and (D) of FIG. 10, when the air inlet ports 361''' and 361'''' are disposed more inside than the air outlet ports 362''' and 362'''', it is possible to reduce a probability that the heated air emitted through the air outlet ports 362''' and 362'''' is reintroduced through the air inlet ports 361''' and 361''''.

Figure 11:
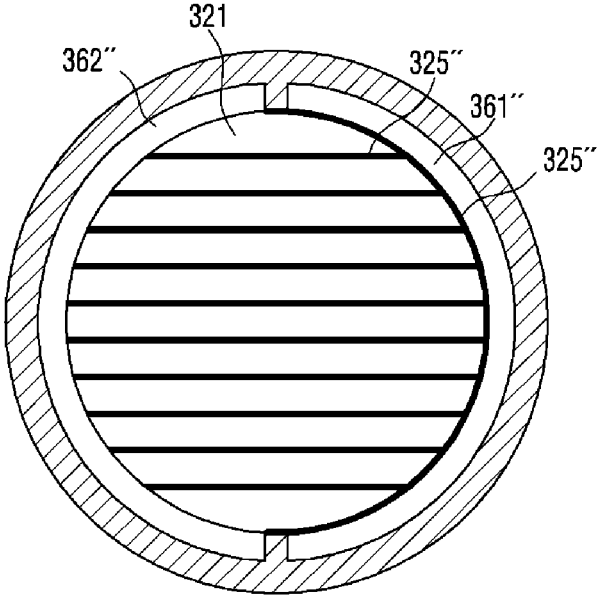
FIG. 11 is a plan view of the heat sink of (B) of FIG. 10.
Figure 12:
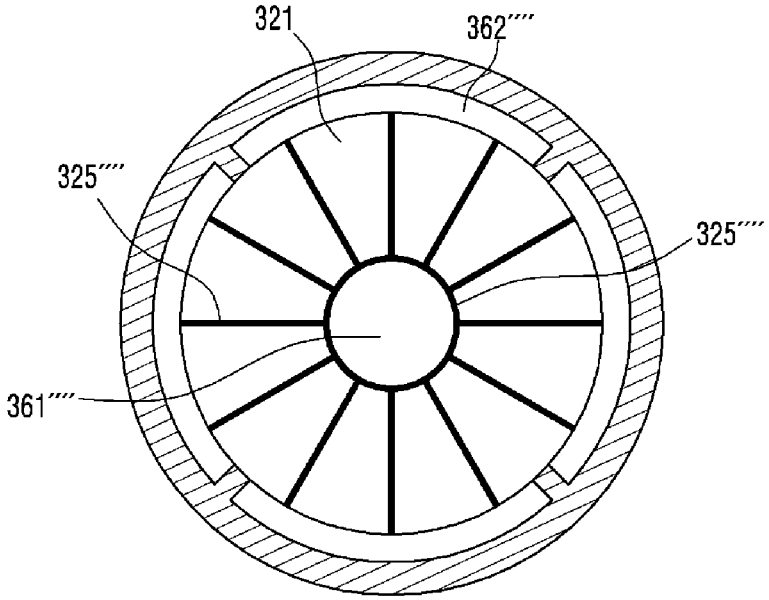
FIG. 12 is a plan view of the heat sink of (D) of FIG. 10.

FIG. 11 is a plan view of the heat sink of (B) of FIG. 10. FIG. 12 is a plan view of the heat sink of (D) of FIG. 10.

Referring to FIGS. 11 and 12, heat radiating fins 325" and 325''' disposed on the base plate 321 are disposed to prevent the air from flowing out through the air inlet ports 361" and 361'''' and to cause the air to be emitted through the air outlet ports 362" and 362''''.

Figure 13:
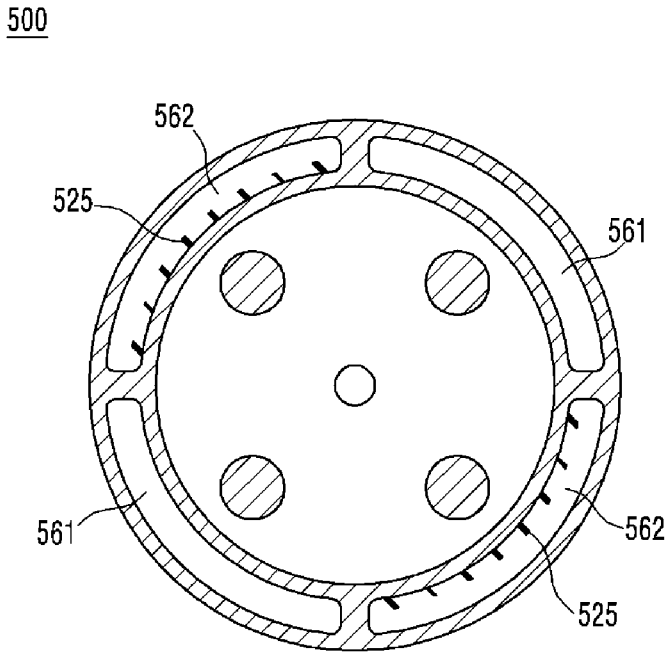
FIG. 13 is a bottom plan view of a lighting device according to further another embodiment of the present invention.
Figure 14:
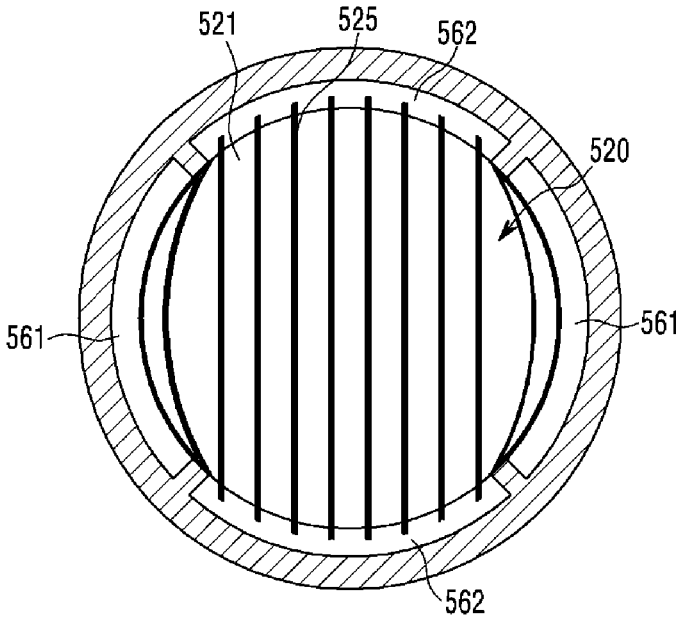
FIG. 14 is a plan view of a heat sink of the lighting device according to the further another embodiment of the present invention.

FIG. 13 is a bottom plan view of a lighting device 500 according to further another embodiment of the present invention. FIG. 14 is a plan view of a heat sink 520 of the lighting device 500 according to the further another embodiment of the present invention.

Referring to FIGS. 13 and 14, the lighting device 500 according to the further another embodiment of the present invention, like the lighting device 300 according to the another embodiment shown in FIGS. 3 to 4, includes an air inlet port 561, an air outlet port 562 and a heat sink 520. The heat sink 520 includes a base plate 521 and heat radiating fins 525 disposed on the base plate 521.

The heat radiating fins 525 of the lighting device 500 according to the further another embodiment are different from those of the lighting device 300 according to the another embodiment.

Some parts of the heat radiating fin 525 of the lighting device 500 according to the further another embodiment are extended to the air outlet port 562. Specifically, the end portion of the heat radiating fin 525 is located in the air outlet port 562. Therefore, the end portion of the heat radiating fin 525 is exposed outward by the air outlet port 562. Through this, the heat radiating fin 525 is able to more efficiently exchange heat with the outside air.

Figure 15:
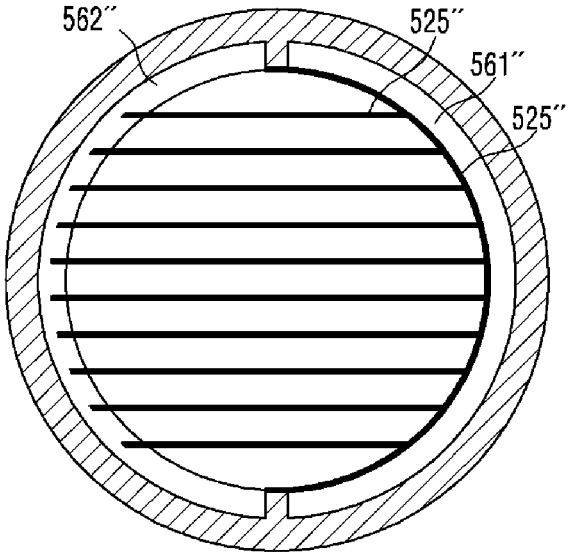
FIG. 15 is a view showing a modified example of the heat sink shown in FIG. 11.
Figure 16:
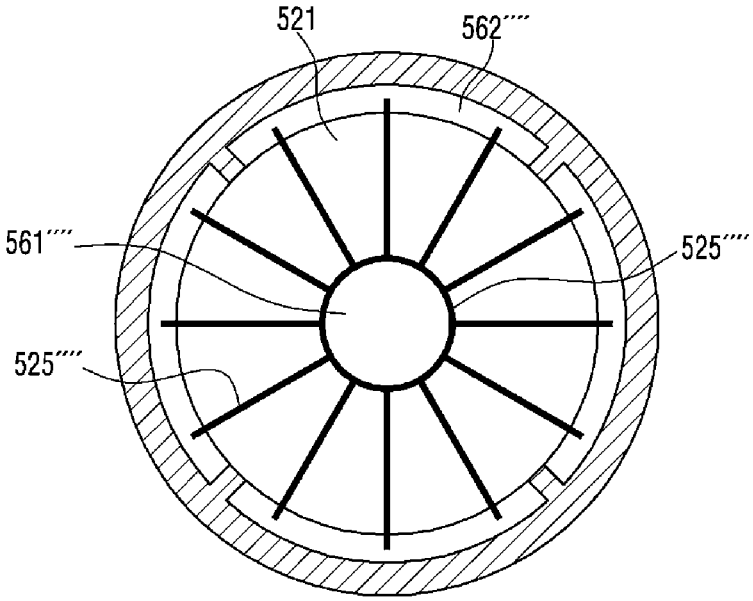
FIG. 16 is a view showing a modified example of the heat sink shown in FIG. 12.

FIG. 15 is a view showing a modified example of the heat sink shown in FIG. 11. FIG. 16 is a view showing a modified example of the heat sink shown in FIG. 12.

FIGS. 15 and 16 show the heat sink to which the heat radiating fins 525 of the lighting device 500 shown in FIGS. 13 and 14 are applied. Specifically, the end portions of the heat radiating fins 525" and 525'''' are disposed in the air outlet port 562" and 562''''.

Figure 17:
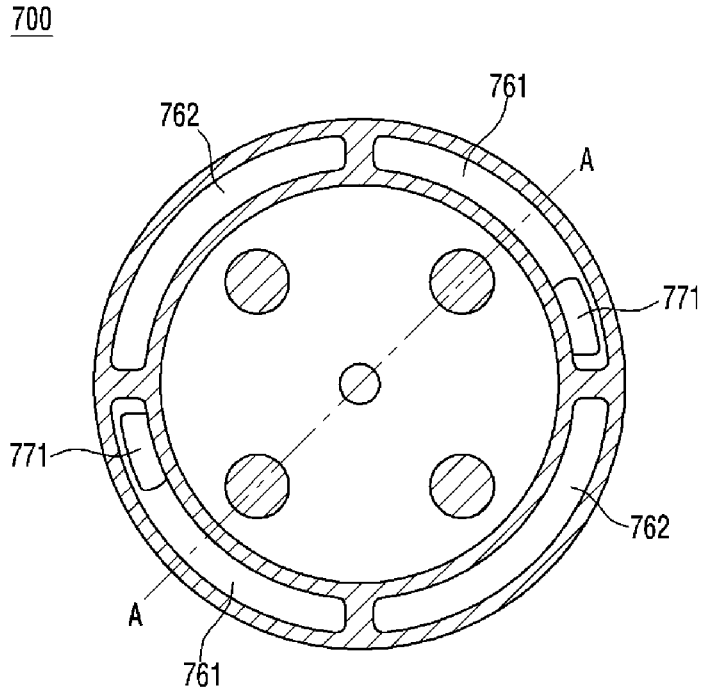
FIG. 17 is a bottom plan view of a lighting device according to yet another embodiment of the present invention.
Figure 18:
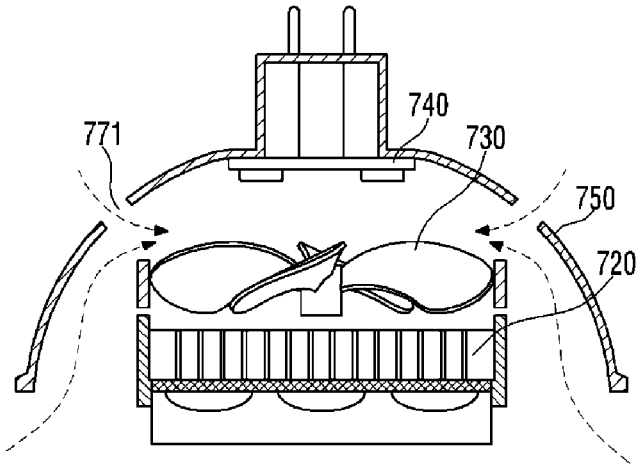
FIG. 18 is a cross sectional view of FIG. 17 taken along line A-A.

FIG. 17 is a bottom plan view of a lighting device 700 according to yet another embodiment of the present invention. FIG. 18 is a cross sectional view of FIG. 17 taken along line A-A.

Referring to FIGS. 17 and 18, in the lighting device 700 according to yet another embodiment, an upper air inlet port 771 may be formed in the upper surface of the housing 750, i.e., the surface of the housing 750 above a heat radiating fan 730. The upper air inlet port 771 may be disposed in the upper surface of the housing 750 perpendicularly corresponding to an air inlet port 761 formed in the lower surface of the housing 750.

In the bottom plan view of the lighting device 700 according to the yet another embodiment, the upper air inlet port 771 formed in the upper surface of the housing 750 can be seen through the air inlet port 761 formed in the lower surface of the housing 750.

In FIGS. 17 and 18, shown is an air introduction path of the lighting device 700 according to the yet another embodiment. Due to the operation of the heat radiating fan 730, the air outside the lighting device 700 passes through the air inlet port 761 and the upper air inlet port 771, and moves to a space between the housing 750 and the upper portion of the heat radiating fan 730.

Referring to FIG. 18, a heat sink 720 may be separated from the air introduction path. As a result, the air introduced from the air inlet port 761 and the upper air inlet port 771 maintains its temperature to be a normal temperature without contact with the heat sink 720 and is introduced into the lighting device. If the introduced air first contacts with the heat sink, heated air is introduced into the space between the housing and the upper portion of the heat radiating fan, so that a driving unit 740 may not be effectively cooled. The introduced air is maintained to have a normal temperature and is moved to the space between the housing 750 and the upper portion of the heat radiating fan 730. Then, the driving unit 740 can be cooled through the heat exchange between the air and the driving unit 740 of the lighting device 700.

Figure 19:
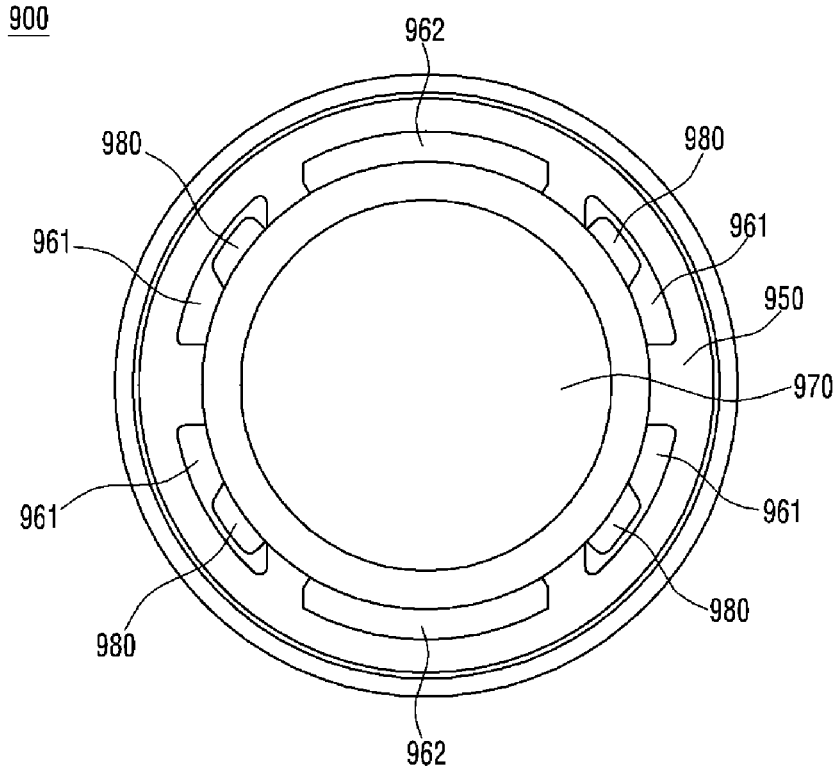
FIG. 19 is a bottom plan view of a lighting device according to still another embodiment of the present invention.
Figure 20:
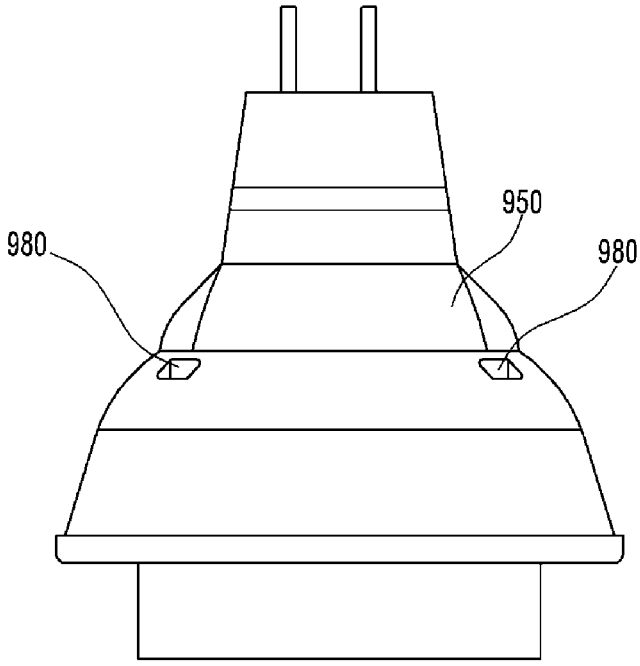
FIG. 20 is a side view of the lighting device shown in FIG. 19.

FIG. 19 is a bottom plan view of a lighting device 900 according to still another embodiment of the present invention. FIG. 20 is a side view of the lighting device 900 shown in FIG. 19.

Referring to FIGS. 19 and 20, the lighting device 900 according to the still another embodiment of the present invention includes the same components as those of the lighting device 300 according to the another embodiment. However, arrangements of the air inlet port and the air outlet port are different from those of the lighting device 300. Therefore, the air inlet port and the air outlet port will be described below.

A lens 970, an air inlet port 961 and an air outlet port 962 may be disposed in the lower portion of a housing 950, that is to say, a portion of the housing 950, through which light is emitted from the light emitting module.

The lighting device 900 according to the still another embodiment includes four air inlet ports 961 formed in the bottom surface of the housing 950 and two air outlet ports 962.

An upper air inlet port 980 may be formed in the top surface of the housing 950, i.e., the surface of the housing 950, which corresponds to the upper portion of the heat radiating fan. The upper air inlet port 980 may be disposed perpendicularly corresponding to the position of the air inlet port 961 formed in the bottom surface of the housing 950.

Therefore, as shown in FIG. 19, the upper air inlet port 980 formed in the top surface of the housing 950 can be seen through the air inlet port 961 formed in the bottom surface of the housing 950.

As shown in FIG. 20, the upper air inlet port 980 may be formed in the top surface of the housing 950. Since the upper air inlet port 980 is formed in addition to the air inlet port 961 formed in the bottom surface of the housing 950, dust introduction is minimized by reducing an air introduction rate, and cooling effect of internal temperature of the lighting device is enhanced by increasing the amount of the air introduced at a normal temperature.

Figure 21:
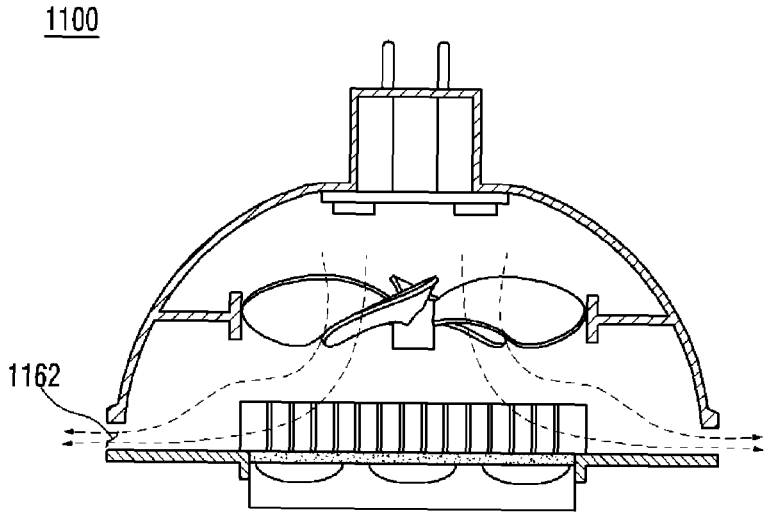
FIG. 21 is a cross sectional view of a lighting device according to still another embodiment of the present invention.

FIG. 21 is a cross sectional view of a lighting device according to still another embodiment of the present invention.

Referring to FIG. 21, an air inlet port of a lighting device 1100 according to still another embodiment of the present invention is similar to that of the lighting device 300 according to the another embodiment. However, an air outlet port 1162 may be configured in such a manner as to emit the heated air in a horizontal direction.

Specifically, the air inlet port is disposed toward the lower portion of the lighting device 1000, i.e., toward an area which the lighting device illuminates or in a direction in which light is emitted. The air outlet port 1162 may be disposed toward the outer circumference of the lighting device 1100. In other words, the air outlet port 1162 may be disposed toward the outside of the lateral surface of the lighting device 1100 or may be disposed obliquely downward.

Since the air emitted through the air outlet port 1162 has a higher temperature than a normal temperature due to the heating thereof, the air tends to rise. Therefore, when the heated air is emitted horizontally to the lighting device 1100 (i.e., toward the outer circumference of the lighting device 1100), the heated air can be more effectively prevented from being reintroduced than when the heated air is emitted perpendicular to the lighting device 1100 (i.e., toward the illumination area of the lighting device 1100).

The following Table 1 shows a simulation result of an LED temperature and a case temperature in an MR16 lighting device with an atmosphere temperature of 25° C. and an applied power of 10 W. A case where only the heat sink is used is compared with cases of embodiments (a) to (d) including the air inlet port and the air outlet port and using the heat radiating fan.

TABLE 1

| | LED temperature [° C.] | Case temperature [° C.] | Remark |
|---|---|---|---|
| Existing (heat sink only) | 161.7 | 66.4 | Atmosphere temperature: 25° C. |
| Embodiment (a) | 145.1 | 75.1 | Applied power: 10 W |
| Embodiment (b) | 146.8 | 66.5 | |
| Embodiment (c) | 129.0 | 81.2 | |
| Embodiment (d) | 140.3 | 94.8 | |

Compared with the case where only the heat sink is used, it can be seen that in the case where the heat radiating fan is also used, the case temperature rises by 0.1° C. to 28° C., however, the LED temperature falls by 16° C. to 32° C.

The following Table 2 shows a result that an internal temperature in a case where the upper air inlet port is disposed in the housing or the top surface of the upper case and an internal temperature in a case where not disposed are tested at a normal temperature of 25□.

TABLE 2

| | Test Point Temp. (° C.) | | |
|---|---|---|---|
| | Case | C. | Remark |
| Case 1 | No Top cover Hole | 89.5 | Based on a normal |
| Case 2 | Top cover Hole | 86.6 | temperature of 25° C. |

As shown in Table 2, the internal temperature of the lighting device in the case where the upper air inlet port is disposed becomes lower.

Considering that the quality characteristic and life span of the LED is affected by the temperature of the LED, the lighting device according to the embodiments of the present invention shows remarkably improved quality characteristic and life span as compared with those of a prior lighting device which uses only the heat sink.

The lighting devices according to various embodiments described above include not only the heat sink and heat radiating fan, but also the air inlet port and the air outlet port which are disposed independently of each other. Accordingly, the cooling efficiency of the lighting device is improved.

The upper air inlet port is additionally disposed in the top surface of the housing as well as the bottom surface of the housing, so that dust introduction is minimized by reducing an air introduction rate. Further, air having a lower temperature is introduced into the top surface, so that the life spans of the driving unit and the fan may become longer.

The lighting devices according to various embodiments described above may be buried-type lighting devices. Also, when the lighting device is buried, the air inlet port and the air outlet port are disposed in externally exposed portion of the lighting device, so that the heat can be effectively exchanged with the external air having a normal temperature.

The lighting devices according to various embodiments described above may be used in a lighting lamp which emits light by collecting a plurality of LEDs. Particularly, in a structure which is buried in a wall or a ceiling and faces toward an illumination area, the lighting device may be used in a buried-type lighting device using the LED which is installed in the structure such that only the front the LED is exposed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light emitting module;

a heat sink disposed on the light emitting module;

a heat radiating fan disposed on the heat sink; and a housing which receives the light emitting module, the heat sink and the heat radiating fan, and includes an air inlet port and an air outlet port which are separated from each other and formed in a direction in which the lighting emitting module irradiates light, wherein the air inlet port and the air outlet port are disposed on the circumference of the housing, and wherein the air inlet port and the air outlet port are alternately disposed.

2. The lighting device of claim 1, wherein the housing includes a partition separating the air inlet port from the air outlet port, wherein the air inlet port is connected to a space between the heat radiating fan and the housing, and wherein the air outlet port is connected to a space between the heat sink and the heat radiating fan.

3. The lighting device of claim 1, wherein the light emitting module comprises a substrate and a light emitting device disposed on the substrate, and wherein the air inlet port and the air outlet port are disposed adjacent to the light emitting module.

4. The lighting device of claim 1, wherein the heat sink comprises:

a base plate disposed on the light emitting module; and a plurality of heat radiating fins disposed on the base plate, wherein a plurality of the heat radiating fins guide air emitted from the heat radiating fan to the air outlet port.

5. The lighting device of claim 1, wherein the housing comprises:

a lower case which receives the heat sink and the light emitting module; and an upper case which receives the heat radiating fan and is coupled to the lower case.

6. The lighting device of claim 5, further comprising a driving unit which is disposed on the heat radiating fan and is received by the upper case.

7. The lighting device of claim 5, wherein the upper case, the lower case and the heat radiating fan respectively have a common hole, and wherein the upper case, the lower case and the heat radiating fan are coupled to each other by inserting a screw into the hole.

8. The lighting device of claim 5, wherein the air inlet port of the housing comprises a first air inlet port and a second air inlet port, wherein the first air inlet port is disposed in the upper case, and the second air inlet port, together with the air outlet port, is disposed in the lower case.

9. The lighting device of claim 1, wherein, by the operation of the heat radiating fan, air having a first temperature is introduced into the air inlet port and air having a second temperature is emitted to the air outlet port, and wherein the second temperature is higher than the first temperature.

10. A lighting device comprising:

a light emitting module;

a heat sink disposed on the light emitting module;

a heat radiating fan disposed on the heat sink; and a housing which receives the light emitting module, the heat sink and the heat radiating fan, and includes an air inlet port and an air outlet port which are separated from each other and formed in a direction in which the lighting emitting module irradiates light, wherein the air inlet port is disposed closer to the center of the housing than the air outlet port.

11. The lighting device of claim 10, wherein the air inlet port is disposed at the center of the housing, and air outlet port is disposed on the circumference of the housing.

12. The lighting device of claim 10, wherein the housing includes a partition separating the air inlet port from the air outlet port, wherein the air inlet port is connected to a space between the heat radiating fan and the housing, and wherein the air outlet port is connected to a space between the heat sink and the heat radiating fan.

13. The lighting device of claim 10, wherein, by the operation of the heat radiating fan, air having a first temperature is introduced into the air inlet port and air having a second temperature is emitted to the air outlet port, and wherein the second temperature is higher than the first temperature.

14. A lighting device comprising:

a light emitting module;

a heat sink disposed on the light emitting module;

a heat radiating fan disposed on the heat sink; and a housing which receives the light emitting module, the heat sink and the heat radiating fan, and includes an air inlet port and an air outlet port, wherein the heat sink comprises a base plate and a plurality of heat radiating fins extended from the base plate, wherein the heat radiating fan injects an air provided from the air inlet port into the heat sink, and wherein the heat radiating fins guide the air to the outlet port of the housing.

15. The lighting device of claim 14, wherein the heat radiating fins are disposed perpendicular to the base plate.

16. The lighting device of claim 14, wherein the heat radiating fins are obliquely disposed toward the center of the base plate.

17. The lighting device of claim 14, wherein the air inlet port and the air outlet port are separated from each other.

18. The lighting device of claim 14, wherein at least one fin of the heat radiating fins blocks in order to not incoming the air onto the inlet port.

19. The lighting device of claim 14, wherein a part of the heat radiating fin is extended to the air outlet port.

20. The lighting device of claim 14, wherein a part of at least one of a plurality of the heat radiating fins is disposed to be exposed in the air outlet port.

* * * * *